US011295917B2

(12) United States Patent
Mochizuki et al.

(10) Patent No.: US 11,295,917 B2
(45) Date of Patent: Apr. 5, 2022

(54) TERMINAL OF RELAY, AND RELAY

(71) Applicant: FUJITSU COMPONENT LIMITED, Tokyo (JP)

(72) Inventors: Masahide Mochizuki, Tokyo (JP); Hiroaki Kohinata, Tokyo (JP); Syunya Kotaki, Tokyo (JP); Kazuaki Miyanaga, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 272 days.

(21) Appl. No.: 16/783,443

(22) Filed: Feb. 6, 2020

(65) Prior Publication Data

US 2020/0266018 A1 Aug. 20, 2020

(30) Foreign Application Priority Data

Feb. 15, 2019 (JP) ..... JP2019-025781

(51) Int. Cl.

| | |
|---|---|
| ***H01H 50/14*** | (2006.01) |
| ***H01H 45/14*** | (2006.01) |
| ***H01H 50/02*** | (2006.01) |
| ***H01H 50/44*** | (2006.01) |
| ***H01H 50/56*** | (2006.01) |
| ***H01H 50/24*** | (2006.01) |

(52) U.S. Cl.

CPC ..... *H01H 50/14* (2013.01); *H01H 45/14* (2013.01); *H01H 50/02* (2013.01); *H01H 50/24* (2013.01); *H01H 50/443* (2013.01); *H01H 50/56* (2013.01)

(58) Field of Classification Search

CPC ..... H01H 50/14; H01H 45/14; H01H 50/02; H01H 50/24; H01H 50/443; H01H 50/56; H01H 50/023

See application file for complete search history.

(56) References Cited

FOREIGN PATENT DOCUMENTS

| | | | |
|---|---|---|---|
| JP | H0574302 | A | 3/1993 |
| JP | 2004063350 | A | 2/2004 |
| JP | 2005050663 | A | 2/2005 |
| JP | 2016072059 | A | 5/2016 |

*Primary Examiner* — Mohamad A Musleh

(74) *Attorney, Agent, or Firm* — Shumaker & Sieffert, P.A.

(57) ABSTRACT

Provided is a terminal of a relay, by which defective sealing in the relay can be prevented. A movable terminal of the relay has: a first plate including a first inner surface, a first outer surface opposed to the first inner surface, and a first through opening which opens to the first inner surface and the first outer surface; a second plate including a second inner surface, a second outer surface opposed to the second inner surface, and a second through opening which opens to the second inner surface and the second outer surface; and a folded part which connects the first plate to the second plate. The first through opening is partially overlapped with the second through opening, and the second inner surface is partially exposed to the first through opening.

8 Claims, 7 Drawing Sheets

TERMINAL OF RELAY, AND RELAY

This application is based upon and claims the benefit of priority of the prior Japanese Patent Application No. 2019-025781, filed Feb. 15, 2019, the entire contents of which are incorporated herein by reference.

TECHNICAL FIELD

The present invention relates to a terminal of a relay, and relates to a relay having the terminal.

BACKGROUND

Relays (electromagnetic relays), in which contacts are opened and closed by an electromagnet, comprise an electromagnet, an armature, a movable terminal including a movable contact, and a fixed terminal including a fixed contact. In such relays, the armature is moved by the excitation of the electromagnet, whereby the armature is pressed against the movable terminal, and contact between the movable contact and the fixed contact come is established.

A sealed relay comprises a base including holes for outwardly guiding legs of a movable terminal and a fixed terminal, and a cover attached to the base, in which the base and the cover are fixed by a seal. The seal is filled in a gap between the base and the cover, or in a gap between the hole of the base and the leg of the terminal, etc., so as to seal the inside of the relay.

JP 2005-050663 A discloses a terminal structure in which a terminal, formed by folding one metal plate in two members, projects from a bottom surface of a housing, and the bottom surface is sealed by sealant.

JP 2004-063350 A discloses a terminal structure in which a terminal formed by folding a band plate projects from a bottom surface of a housing, and an outer surface is sealed by sealant. The terminal folded in two members has a notch at one of the folded plates for introducing sealant to the inside of the terminal.

JP 2016-072059 A discloses a terminal structure having a layered terminal, in which a communication hole is formed for communicating an inner space formed between opposing surfaces of the terminal with the outside.

JP H05-074302 A discloses a structure for eliminating defective sealing at a terminal having a folded outer contact. As a means for flowing sealant into a folded portion, an outer surface of the folded portion of the outer contact has a notch having a depth larger than the plate thickness.

SUMMARY

In relays comprising a terminal in which a leg folded in two members, a defective sealing such as a crack may be generated in the sealant for sealing the gap between the base and the leg.

One aspect of the present invention is a terminal of a relay, comprising: a first plate part having a first inner surface, a first outer surface opposed to the first inner surface, and a first through opening which opens on the first inner surface and the first outer surface; a second plate part having a second inner surface, a second outer surface opposed to the second inner surface, and a second through opening which opens on the second inner surface and the second outer surface; and a folded part which connects the first plate part to the second plate part, wherein the first through opening is partially overlapped with the second through opening, and the second inner surface is partially exposed to the first through opening.

Another aspect of the present invention is a relay, comprising: a base; a cover attached to the base; the terminal according to the one aspect attached to the base; and a seal which seals a gap between the base, the cover and the terminal, wherein the seal is filled in the first through opening and the second through opening of the terminal.

According to the terminal of the one aspect, the through openings overlapped with each other are provided to the first plate and the second plate, and the second inner surface is partially exposed to the first through opening. Therefore, when the terminal is used in a hermetically sealed relay, the first and second through openings are filled with the seal, and the seal flows between the first and second plates via the exposed portion of the second inner surface. As a result, the seal having an integral shape passing through the first and second through openings is formed so as to be sterically engaged to both of the first and second plates, whereby a defective sealing such as a crack can be prevented from being generated in the seal.

According to the relay of the other aspect, by providing the terminal of the one aspect to the relay, rough openings overlapped with each other are provided to the first plate and the second plate, the defective sealing such as a crack can be prevented from being generated in the seal.

DETAILED DESCRIPTION

Figure 1:
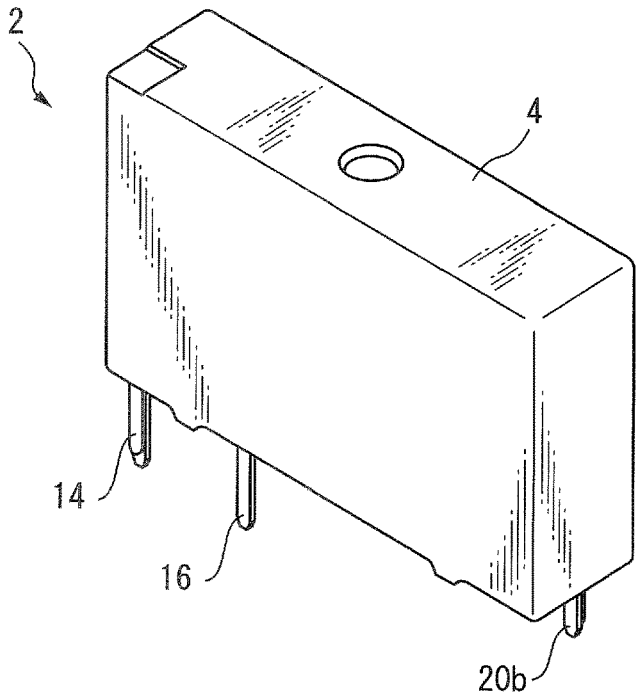
FIG. 1 is a perspective view of a relay according to an embodiment.
Figure 2:
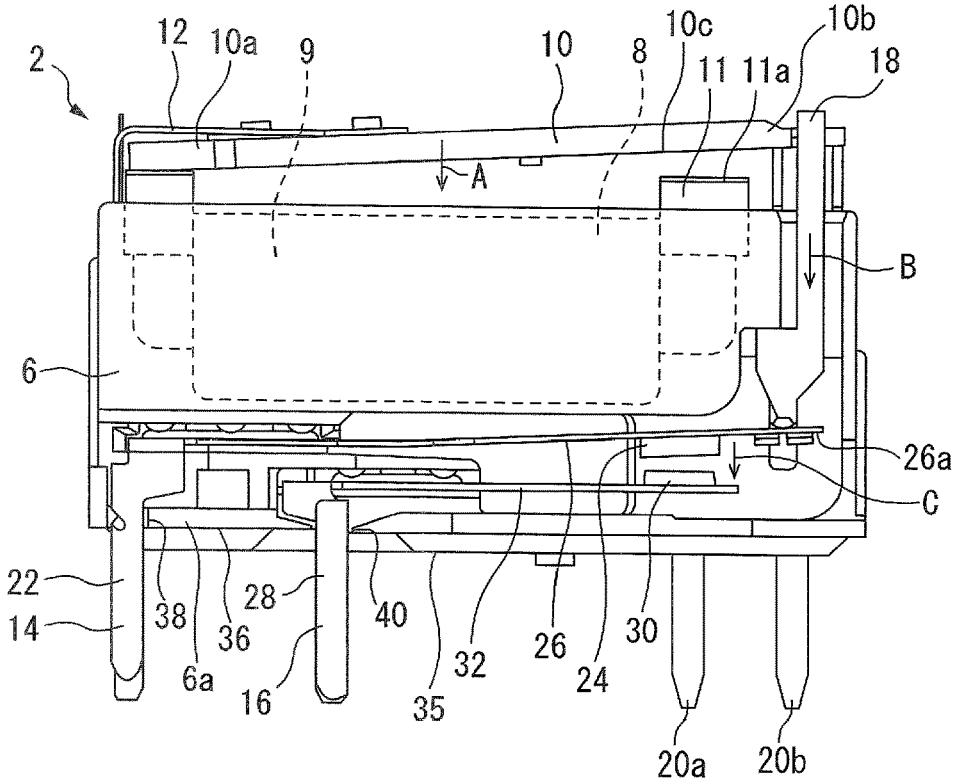
FIG. 2 is view of an inner structure of the relay.

An embodiment of the present disclosure will be described below with reference to the attached drawings. FIG. 1 is a perspective view of a relay 2. The relay 2 has a box-shaped cover 4. FIG. 2 is a front view of relay 2 while the cover 4 is removed. The relay 2 comprises a base 6 which supports various components and is attached to the cover 4. The cover 4 and the base 6 may be, for example, made of resin.

The components supported by the base 6 include an electromagnet 8, an armature 10, a hinge spring 12, a movable terminal 14, a fixed terminal 16, and a pressing member 18. The electromagnet 8 includes a coil 9 and an iron core 11. The coil 9 is connected to coil terminals 20*a*, 20*b*.

The armature 10 is formed as a plate, for example, made from a magnetic material such as a metal. At the side of an end 10*a* of the armature 10, the hinge spring 12 is positioned. The hinge spring 12 elastically biases an end 10*b* of the armature 10 in a direction away from an adsorption surface 11*a* of the iron core 11.

The movable terminal 14 comprises a leg 22 connected to an external device, and a contact part 26 having a movable contact 24. The contact part 26 is elastically deflected by a force from the pressing member 18. The movable terminal 14 is made, for example, from a plate member such as a metal ("a metal plate").

The fixed terminal 16 comprises a leg 28 connected to the external device, and a contact part 32 having a fixed contact 30. The fixed terminal 16 is made, for example, from a metal plate.

The pressing member 18 is connected to the armature 10, and transmits the motion of the armature 10 to the movable terminal 14. The pressing member 18 is connected to the end 10*b* of the armature 10 and an end 26*a* of the contact part 26 of the movable terminal 14. The pressing member 18 is movable in the vertical direction in FIG. 2. The pressing member 18 is made, for example, from a resin.

The electromagnet 8 is excited by applying a voltage to the coil terminals 20*a*, 20*b*. Due to the excitation of the electromagnet 8, the armature 10 is attracted by the iron core 11 and is moved in a direction A, and then a surface 10*c* of the armature 10 is adsorbed by the adsorption surface 11*a*. In conjunction with the movement of the armature 10 in the direction A, the pressing member 18 moves in a direction B. Further, in conjunction with the movement of the pressing member 18 in the direction B, the contact part 26 of the movable terminal 14 connected to the pressing member 18 moves in a direction C. When the contact part 26 moves in the direction C, the movable contact 24 comes into contact with the fixed contact 30.

When the application of voltage to the coil terminals 20*a*, 20*b* is stopped, the surface 10*c* is separated from the adsorption surface 11*a* by the hinge spring 12, and then the armature 10 returns in a direction opposed to the direction A. The pressing member 18 moves in a direction opposed to the direction B as the armature 10 returns, and then the pressing force from the pressing member 18 to the movable terminal 14 is released. As the pressing force is released, the contact part 26 moves in a direction opposed to the direction C. When the contact part 26 moves in the direction opposed to the direction C, the movable contact 24 separates from the fixed contact 30.

Due to the above configuration, the movable contact 24 and the fixed contact 30 of the relay 2 open and close.

Figure 3:
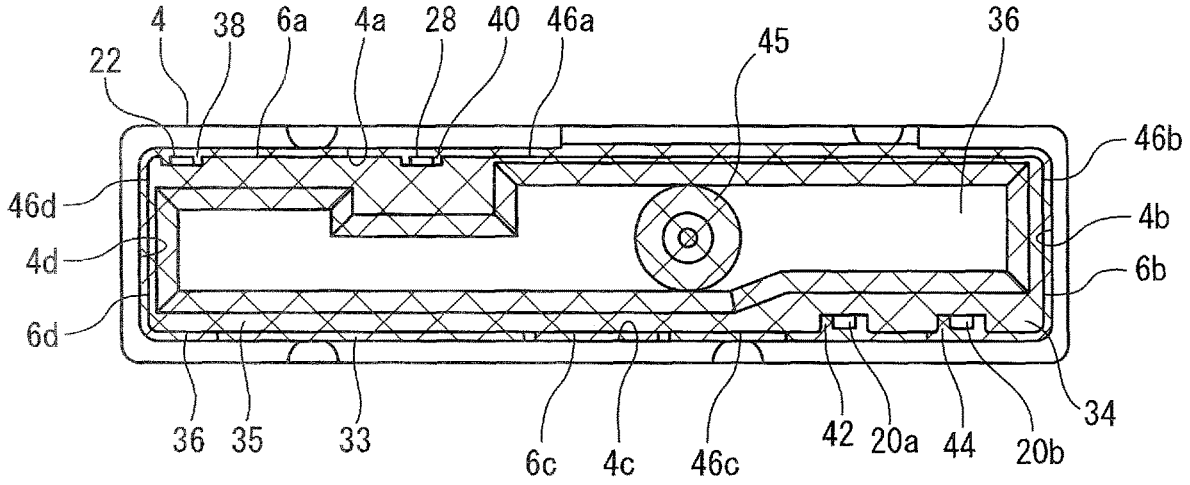
FIG. 3 is a bottom view of the relay.

FIG. 3 is a bottom view of the relay 2. A cross-hatched portion in FIG. 2 indicates a seal 34. The seal 34 is adhesive agent such as epoxy resin.

The cover 4 is a rectangular parallelepiped, and has an opening 33 at one end thereof. The base 6 has a bottom 35, and the bottom 35 is contained in the cover 4 so that the bottom 35 close the opening 33. Four inner surfaces 4*a*, 4*b*, 4*c* and 4*d* of the cover 4 face four outer surfaces 6*a*, 6*b*, 6*c* and 6*d* of the bottom 35 each other, respectively. Recesses 38, 40, which dent in a direction away from the inner surface 4*a*, are formed on the outer surface 6*a*.

As shown in FIG. 2, the leg 22 is guided to the outside of the relay 2 through the recess 38. The leg 28 is guided to the outside of the relay 2 through the recess 40. Recesses 42, 44, which dent in a direction away from the inner surface 4*c*, are formed on the outer surface 6*c*. The coil terminals 20*a*, 20*b* are guided the outside of the relay 2 through the recesses 42, 44.

In order to facilitate assembling, the bottom 35 is clearance-fitted in the cover 4. Therefore, gaps 46*a*, 46*b*, 46*c* and 46*d* are formed between the inner surface 4*a* and the outer surface 6*a*, between the inner surface 4*b* and the outer surface 6*b*, between the inner surface 4*c* and the outer surface 6*c*, and between the inner surface 4*d* and the outer surface 6*d*, respectively.

The seal 34 is applied to the bottom 35 and an outer surface 36, and filled in the gaps 46*a*, 46*b*, 46*c* and 46*d*, and recesses 38, 40, 42 and 44. After this filling, the seal 34 is further applied to an opening 45 formed on the bottom 35, and seals the inside of the relay 2. Moreover, the seal 34 fixes the base 6, the movable terminal 14, the fixed terminal 16 and the coil terminals 20*a*, 20*b* to each other.

Figure 4:
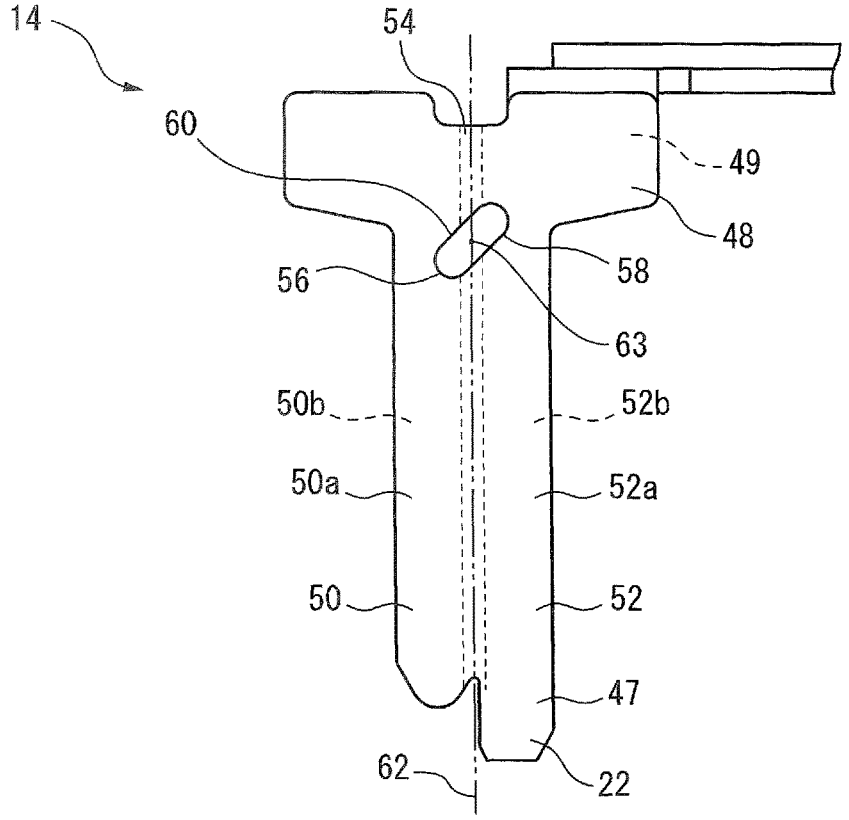
FIG. 4 is a development view of a terminal leg of the relay.

The movable terminal 14 according to an embodiment will be described below with reference to FIGS. 4 to 9. FIG. 4 is a development view of the leg 22. The leg 22 is formed from single metal plate 48.

The leg 22 has a first plate 50, a second plate 52, and a folded part 54 which connects the first plate 50 to the second plate 52.

The first plate 50 has a first inner surface 50*a*, and a first outer surface 50*b* opposed to the first inner surface 50*a*. The second plate 52 has a second inner surface 52*a*, and a second outer surface 52*b* opposed to the second inner surface 52*a*.

The first plate 50 has a first through opening 56 which penetrates the metal plate 48. The second plate 52 has a second through opening 58 which penetrates the metal plate 48.

The first through opening 56 and the second through opening 58 communicate with each other, and form a single through opening 60. For example, by forming the through opening 60 on the metal plate 48 by press working, the first through opening 56 and the second through opening 58 can be formed. The through opening 60 may have an arbitrary size, and may have an arbitrary shape such as a circle, an ellipse, a triangle, or a rectangle. The through opening 60 has asymmetric shape with respect to a folding line 62 positioned at the folded part 54. In this embodiment, the through opening 60 is an elongate hole which intersects with the folding line 62 at an oblique angle, and has a symmetric shape with respect to a center 63 positioned on the folding line 62. The area of the through opening 60 is divided in half by the folding line 62. Further, the through opening 60 may have a shape so that the center 62 is not positioned on the folding line 62.

The leg 22 is formed by folding the metal plate 38 along the folding line 48. By folding the metal plate 48, the first through opening 56 and the second through opening 58 are partially overlapped with each other.

Figure 5:
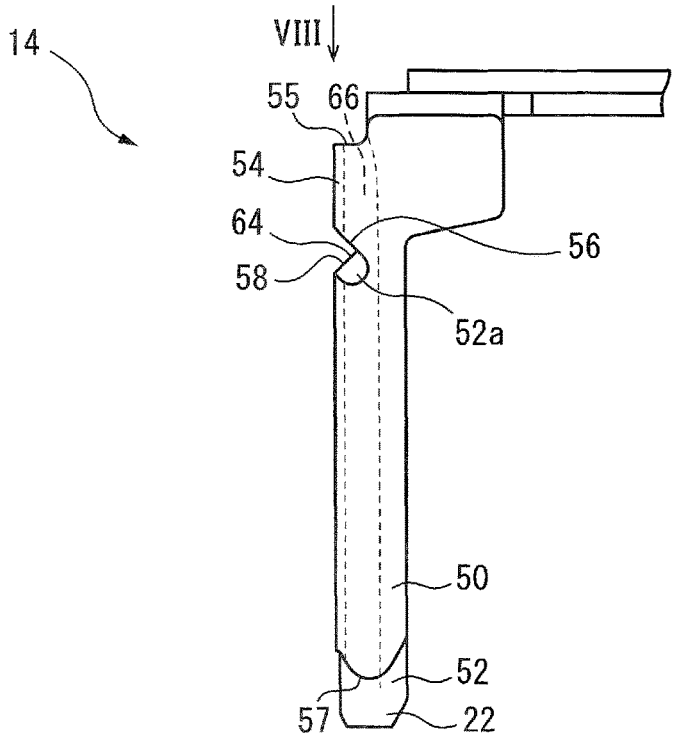
FIG. 5 is a view of a finish product of the leg.
Figure 6:
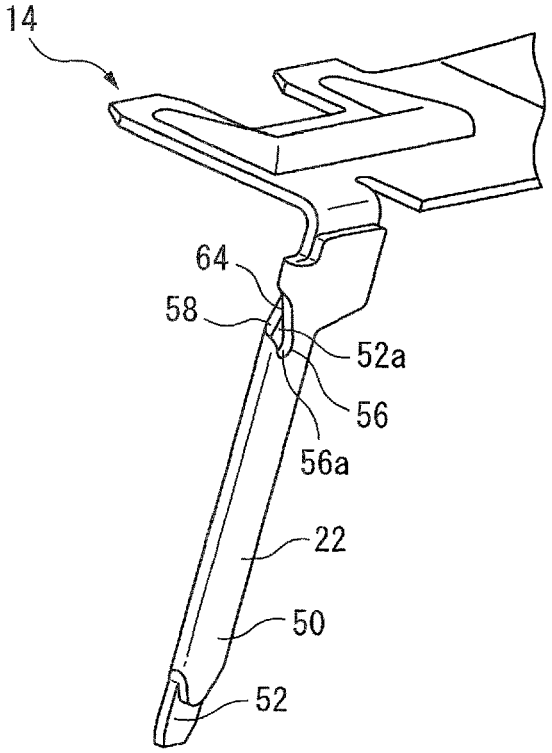
FIG. 6 is a perspective view of the leg.

FIG. 5 is a view of a finish product of the leg 22 viewed from the side of the first plate 50. FIG. 6 is a perspective view of the leg 22 of FIG. 5. By the partial overlapping between the first through opening 56 and the second through opening 58, a notch 64 which has a cutout shape in the folded part 54 is formed. In the embodiment, the shape of the notch 64 is a triangle as shown in FIG. 5.

further, as shown in FIGS. 5 and 6, by the partial overlapping of the first through opening 56 with the second through opening 58, the second inner surface 52*a* is partially exposed to the first through opening 56.

Figure 7:
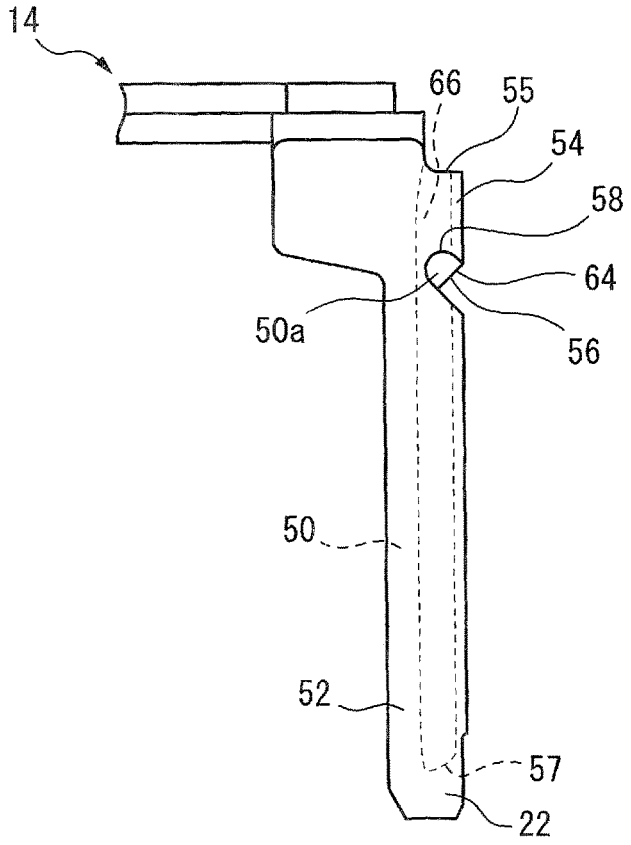
FIG. 7 is a view of the leg viewed from the opposite side.

FIG. 7 shows the leg 22 of FIG. 5 viewed from the side of the second plate 52. By the partial overlapping of the second through opening 58 with the first through opening 56, the first inner surface 50*a* is partially exposed to the second through opening 58.

Figure 8:
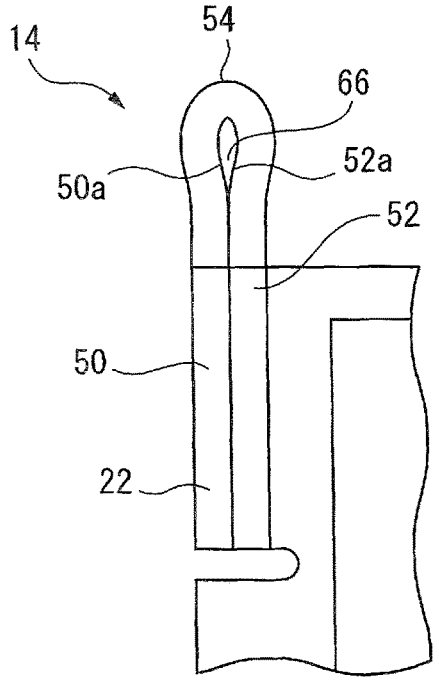
FIG. 8 is a view of the leg viewed in a direction of an arrow VIII.

FIG. 8 shows the leg 22 viewed in a direction of an arrow VIII in FIG. 5. The thickness of the leg 22 in the left-right direction in FIG. 8 is obtained by the overlapping between the first plate 50 and the second plate 52. Therefore, the leg 22 has a structure robust against deformation due to an external force.

As shown in FIG. 8, by bending using a press machine, etc., a gap 66 may be formed along the folded part 54, by which the first inner surface 50*a* and the second inner surface 52*a* do not contact each other. In FIGS. 5 and 7, the gap 66 extends along the entire length of the folded part 54 as indicated by a dot line, and opens at an upper end 55 and a lower end 57 of the leg 22. In FIG. 8, the gap 66 communicates with both the first through opening 56 and the second through opening 58.

When assembling the relay 2, the cover 4 is attached to the base 6, and then the seal 34 is applied to the outer surface 36. The seal 34 is filled in the recess 38, and flows into the first through opening 56 and the second through opening 58 of the leg 22. Further, the seal 34 enters the gap 66 through the second inner surface 52*a* exposed to the first through opening 56 and the first inner surface 50*a* exposed to the second through opening 58.

After executing the above processes, the seal 34 is filled in the first through opening 56, the second through opening 58 and the gap 66. As a result, the seal 34 having the integral shape passing through the first through opening 56 and the second through opening 58 is formed so as to be sterically engaged to both of the first plate 50 and the second plate 52.

Even when the external force is applied to the leg 22, the first plate 50 and the second plate 52 grapple the sterically engaged seal 34, and thus the leg 22 is hard to move in the recess 38. Since the leg 22 is hard to move, interface separation between the leg 22 and the seal 34 is hard to occur, and thus a crack in the seal 34 in the recess 38 is hard to be generated. Even when a crack is generated in the seal 34 on the bottom 35, the crack is hard to travel to the seal 34 which cures integrally and sterically over the both sides of the leg 22 in the recess 38. Therefore, by virtue of the movable terminal 14 of the present embodiment, defective sealing in the relay 2 can be avoided.

Since the seal 34 enters the gap 66 via the partially exposed first inner surface 50*a* and the partially exposed second inner surface 52*a*, the gap 66 can also be filled with the seal 34, and thus the sealability of the relay 2 can be improved. Also, since the seal 34 is filled in the gap 66, the positional deviation between the first plate 50 and the second plate 52 is hard to occur, even when the external force is applied to the leg 22.

In the movable terminal 14, by changing the shape, the size and the angle, etc., of the through opening 60, and by arbitrary changing the exposed areas of the first inner surface 50*a* and the second inner surface 52*a*, the ease of flow of the seal 34 into the gap 66 can be adjusted. For example, the through opening 60 may be formed so that only one of the first inner surface 50*a* and the second inner surface 52*a* is exposed. Since the through opening 60 is formed by one pressing, such a design change can be easily realized at low cost.

Figure 9:
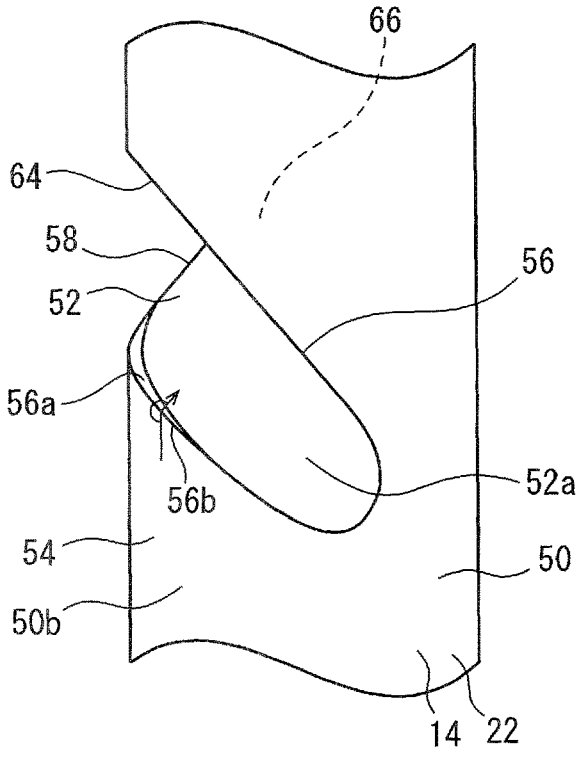
FIG. 9 is an enlarged view of a main part of the leg.

FIG. 9 is an enlarged view of the leg 22. When bending the first plate 50 and the second plate 52 of FIG. 4, the first outer surface 50*b* and the second outer surface 52*b* are extended larger than the first inner surface 50*a* and the second inner surface 52*a* around the folded part 54, and thus an inner peripheral surface 56*a* (only a lower part thereof is illustrated) of the through opening 56, which obliquely intersects the folding line 62, is sterically bent so that the inner peripheral surface 56*a* is pulled toward the side of the first outer surface 50*b* from a portion separated from the folded part 54 to a portion close to the folded part 54. By virtue of the sterically bending, the inner peripheral surface 56*a* is connected to the first outer surface 50*b* at an obtuse angle, in particular around the folded part 54. Similarly, an inner peripheral surface (not shown) of the second through opening 58 is connected to the second outer surface 52*b* at an obtuse angle, in particular around the folded part 54.

Since the first outer surface 50*b* and the inner peripheral surface 56*a* are connected to each other at the obtuse angle, the seal 34 can easily extend over an intersection part 56*b* between the first outer surface 50*b* and the inner peripheral surface 56*a*. In particular around the folded part 54, the seal 34 can easily travel from the first through opening 56 to the exposed portion of the second inner surface 52*a*, and can easily enter the gap 66. By forming at least one of the first through opening 56 and the second through opening 58 so as to obliquely intersect with the folding line 62 of the metal plate 48, the filling of the seal 34 in the entire of the first through opening 56 and the second through opening 58, and the entering of the seal 34 into the gap 66, can be promoted.

A manufacturing method of the movable terminal 14 is explained with reference to FIG. 4. The leg 22 is formed by folding the metal plate 48. First, the through opening 60, which extends through an inner surface 47 and an outer surface 49 of the metal plate 48, is formed. Then, a pair of the first plate 50 and the second plate 52 overlapping with each other are formed by bending the metal plate 48, and a portion of the through opening 60 is overlapped with another portion between the first plate 50 and the second plate 52. By overlapping the portion of the through opening 60 with the other portion, one of the plate 50 or the plate 52 is exposed to the through opening 60 at the other of the plate 50 or the plate 52, and the leg 22 as shown in FIGS. 5 and 6 is manufactured.

As described above, in the present embodiment, the through opening 60 is an elongate hole having the asymmetric shape on the both sides of the folding line 62 of the metal plate 48. For example, the forming of the through opening 60 is realized by press working.

By virtue of the above method, the leg 22 can be simply manufactured.

Furthermore, although the movable terminal 14 is exemplified, the above configuration and the manufacturing method may be applied to the other terminal such as the fixed terminal 16.

Figure 10:
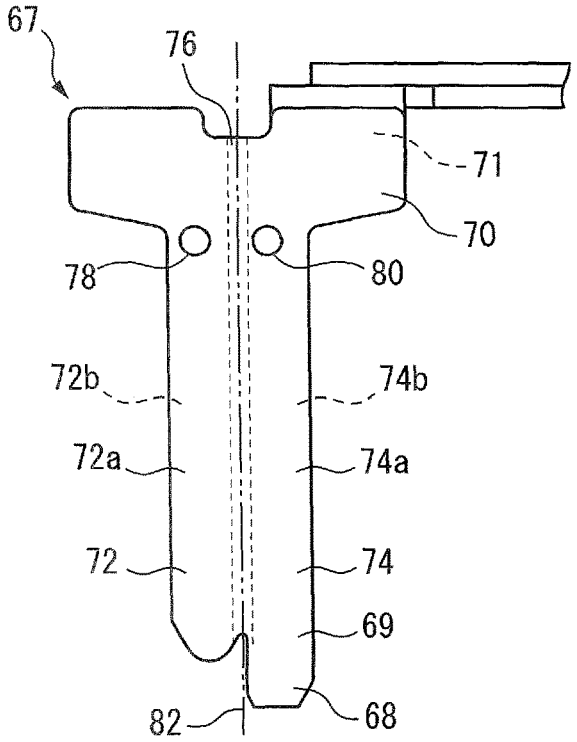
FIG. 10 is a development view of a terminal leg of according to a modification.

Hereinafter, with reference to FIGS. 10 to 13, the configuration of a movable terminal 67 according to a modification is explained. FIG. 10 is a development view of the a leg 68 of the movable terminal 67. The leg 68 is formed from a single metal plate 70.

The leg 68 has a first plate 72, a second plate 74, and a folded part 76 which connects the first plate 72 to the second plate 74.

The first plate 72 has a first inner surface 72*a* and a first outer surface 72*b*. The second plate 74 has a second inner surface 74*a* and a second outer surface 74*b*.

The first plate 72 has a first through opening 78 which penetrates the metal plate 70. The second plate 74 has a second through opening 80 which penetrates the metal plate 70.

For example, the first through opening 78 and the second through opening 80 can be formed by press working. Each of the first through opening 78 and the second through opening 80 may have an arbitrary size, and may have an arbitrary shape such as a circle, an ellipse, a triangle, or a rectangle. The first through opening 78 and the second through opening 80 are positioned so that the openings are asymmetric with respect to a folding line 82 positioned at the folded part 76, and so that the openings are partially overlapped with each other when the metal plate 70 is folded along the folding line 82. In the present embodiment, the first through opening 78 and the second through opening 80 are circular holes having the same shape and the same size.

The leg 68 is formed by folding the metal plate 70 along the folding line 82. By folding the metal plate 70, the first through opening 78 and the second through opening 80 are partially overlapped with each other.

Figure 11:
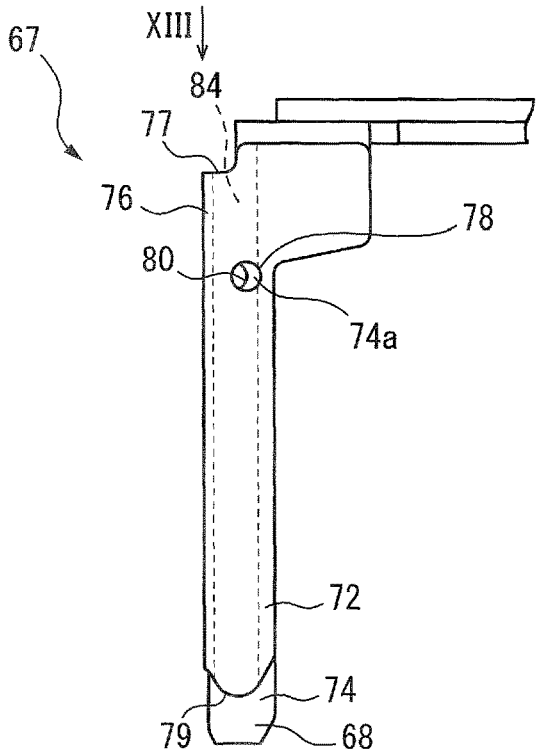
FIG. 11 is a view of a finish product of the leg.

FIG. 11 is a view of the leg 68 viewed from the side of the first plate 72. By the partial overlapping of the first through opening 78 with the second through opening 80, the second inner surface 74*a* is partially exposed to the first through opening 78.

Figure 12:
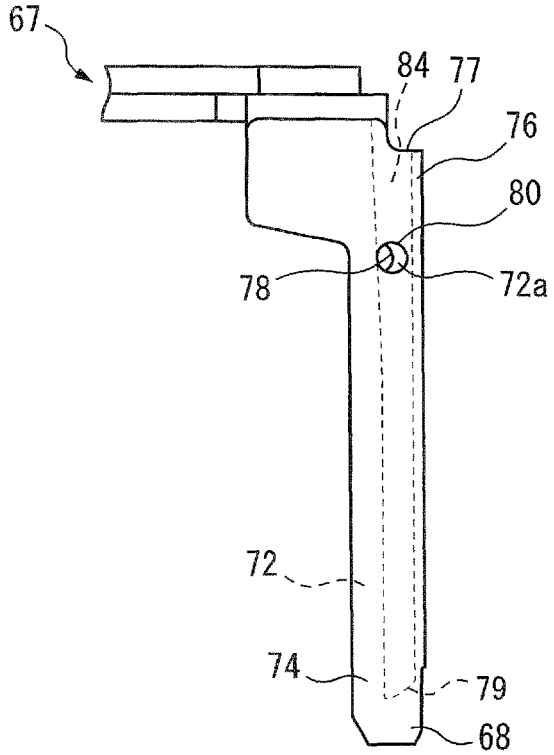
FIG. 12 is a view of the leg of FIG. 11 viewed from the opposite side.

FIG. 12 is a view of the leg 68 of FIG. 10 viewed from the side of the second plate 80. By the partial overlapping of the second through opening 80 with the first through opening 78, the first inner surface 72*a* is partially exposed to the second through opening 80.

Figure 13:
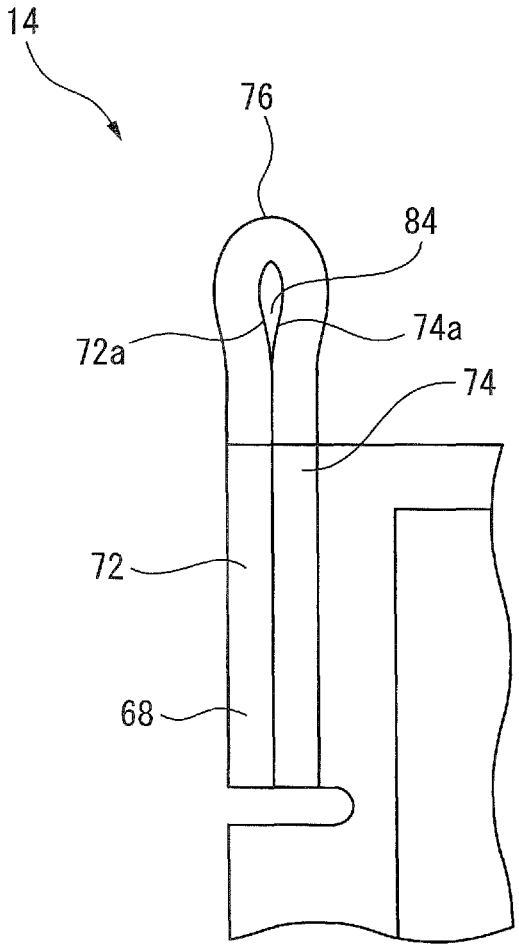
FIG. 13 is a view of the leg of FIG. 11 viewed in a direction of an arrow XIII.

FIG. 13 shows the leg 68 viewed in a direction of an arrow XIII in FIG. 11. The thickness of the leg 68 in the left-right direction in FIG. 13 is obtained by the overlapping between the first plate 72 and the second plate 74. Therefore, the leg 68 has a structure robust against deformation due to an external force.

As shown in FIG. 13, by bending using a press machine, etc., a gap 84 may be formed along the folded part 76, by which the first inner surface 72*a* and the second inner surface 74*a* do not contact each other. In FIGS. 11 and 12, the gap 84 extends along the entire length of the folded part 76 as indicated by a dot line, and opens at an upper end 77 and a lower end 79 of the leg 68. In the drawings, the gap 84 communicates with both the first through opening 78 and the second through opening 80.

As described above, when assembling the relay 2, the seal 34 is applied to the outer surface 36. The seal 34 is filled in the recess 38, and flows into the first through opening 78 and the second through opening 80. Further, the seal 34 enters the gap 84 through the second inner surface 74*a* partially exposed to the first through opening 78 and the first inner surface 72*a* partially exposed to the second through opening 80.

After executing the above processes, the seal 34 is filled in the first through opening 78, the second through opening 80 and the gap 84. As a result, the seal 34 having the integral shape passing through the first through opening 78 and the second through opening 80 is formed so as to be sterically engaged to both of the first plate 72 and the second plate 74.

Even when the external force is applied to the leg 68, the first plate 72 and the second plate 74 grapple the sterically engaged seal 34, and thus the leg 68 is hard to move in the recess 38. Since the leg 68 is hard to move, interface separation between the leg 68 and the seal 34 is hard to occur, and thus a crack in the seal 34 in the recess 38 is hard to be generated. Even when a crack is generated in the seal 34 on the bottom 35, the crack is hard to travel to the seal 34 which cures integrally and sterically over the both sides of the leg 68 in the recess 38. Therefore, defective sealing in the relay 2 can be avoided.

Since the seal 34 enters the gap 84 via the partially exposed first inner surface 72*a* and the partially exposed second inner surface 74*a*, the gap 84 can also be filled with the seal 34, and thus the sealability of the relay 2 can be improved. Also, since the seal 34 is filled in the gap 84, the positional deviation between the first plate 72 and the second plate 74 is hard to occur, even when the external force is applied to the leg 68.

A manufacturing method of the leg 68 is explained with reference to FIG. 10. First, the first through opening 78 and the second through opening 80, which extend through an inner surface 69 and an outer surface 71 of the metal plate 70, are formed. Then, by folding the metal plate 70, the first through opening 78 and the second through opening 78 are overlapped with each other, between the first plate 72 and the second plate 74. By partially overlapping the first through opening 78 with the second through opening 80, one of the plate 74 (or 72) is exposed to the through opening 78 (or 80) at the other of the plate 72 (or 74), and the leg 68 as shown in FIG. 11 is manufactured.

As described above, in the present embodiment, the first through opening 78 and the second through opening 80 are asymmetrically positioned on the sides of the folding line 82, and are circular holes having the same shape and the same size. For example, the first through opening 78 and the second through opening 80 are formed by press working. Furthermore, the first through opening 78 and the second through opening 80 may be formed as asymmetrical shapes on the sides of the folding line 82 (e.g., the first through opening 78 may be a circle, and the second through opening 80 may be an ellipse).

By virtue of the above method, the leg 68 of the movable terminal 67 can be simply manufactured.

Furthermore, although the movable terminal 67 is exemplified, the above configuration and the manufacturing method may be applied to the other terminal such as the fixed terminal 16.

The embodiments described above can be appropriately combined. Furthermore, in the drawings described above, identical or corresponding portions are assigned the same reference signs. Note that the embodiments described above are merely exemplary and do not limit the invention.

The invention claimed is:

1. A terminal of a relay, comprising:

a first plate part having a first inner surface, a first outer surface opposed to the first inner surface, and a first through opening which opens on the first inner surface and the first outer surface;

a second plate part having a second inner surface, a second outer surface opposed to the second inner surface, and a second through opening which opens on the second inner surface and the second outer surface; and a folded part which connects the first plate part to the second plate part, wherein the first through opening is partially overlapped with the second through opening, and the second inner surface is partially exposed to the first through opening.

2. The terminal according to claim 1, wherein the first inner surface is partially exposed to the second through opening.

3. The terminal according to claim 1, wherein the first through opening and the second through opening form a notch which has a cutout shape in the folded part.

4. The terminal according to claim 3, wherein an inner peripheral surface of the first through opening is connected to the first outer surface at an obtuse angle.

5. A relay, comprising:

a base;

a cover attached to the base;

a terminal of a relay comprising:

a first plate part having a first inner surface, a first outer surface opposed to the first inner surface, and a first through opening which opens on the first inner surface and the first outer surface;

a second plate part having a second inner surface, a second outer surface opposed to the second inner surface, and a second through opening which opens on the second inner surface and the second outer surface; and a folded part which connects the first plate part to the second plate part, wherein the first through opening is partially overlapped with the second through opening, and the second inner surface is partially exposed to the first through opening; and a seal which seals a gap between the base, the cover and the terminal, wherein the seal is filled in the first through opening and the second through opening of the terminal.

6. The relay according to claim 5, wherein the first inner surface is partially exposed to the second through opening.

7. The relay according to claim 5, wherein the first through opening and the second through opening form a notch which has a cutout shape in the folded part.

8. The relay according to claim 7, wherein an inner peripheral surface of the first through opening is connected to the first outer surface at an obtuse angle.

* * * * *